US005765479A

United States Patent [19]

Hummel et al.

[11] Patent Number: 5,765,479

[45] Date of Patent: Jun. 16, 1998

[54] DAMPENING UNIT FOR AN OFFSET PRINTING MACHINE

[75] Inventors: Peter Hummel, Offenbach am Main; Robert Ortner, Alzenau, both of Germany

[73] Assignee: MAN Roland Druckmaschinen AG, Germany

[21] Appl. No.: 689,399

[22] Filed: Aug. 9, 1996

[30] Foreign Application Priority Data

Aug. 9, 1995 [DE] Germany ..... 195 29 205.7

[51] Int. Cl.[6] ..... B41L 25/00

[52] U.S. Cl. ..... 101/148

[58] Field of Search ..... 101/148

[56] References Cited

U.S. PATENT DOCUMENTS

| | | | |
|---|---|---|---|
| 1,755,278 | 4/1930 | Strain | 101/148 |
| 2,301,334 | 11/1942 | Schulz | 101/148 |
| 3,613,575 | 10/1971 | Kantor | 101/148 |
| 3,673,959 | 7/1972 | Jezuit et al. | 101/148 |
| 3,732,620 | 5/1973 | Misch et al. . | |
| 3,835,597 | 9/1974 | Wasil | 101/148 |
| 3,842,735 | 10/1974 | Southam et al. | 101/148 |
| 3,916,789 | 11/1975 | Watts et al. | 101/148 |
| 3,926,116 | 12/1975 | Wildeman | 101/148 |
| 4,211,167 | 7/1980 | Corse | 101/148 |
| 4,287,827 | 9/1981 | Warner | 101/148 |
| 4,385,559 | 5/1983 | Jarach | 101/148 |
| 4,524,690 | 6/1985 | Omori | 101/148 |
| 4,686,901 | 8/1987 | Arndtt et al. | 101/148 |
| 4,724,764 | 2/1988 | MacPhee et al. | 101/148 |
| 4,972,771 | 11/1990 | Weisgerber et al. | 101/148 |
| 5,027,704 | 7/1991 | Holl et al. | 101/148 |
| 5,218,903 | 6/1993 | MacConnell et al. | 101/148 |
| 5,562,031 | 10/1996 | Garner et al. | 101/148 |

FOREIGN PATENT DOCUMENTS

| | | |
|---|---|---|
| 1 39 816 | 1/1980 | Germany . |
| 31 32 223 A1 | 4/1982 | Germany . |
| 39 08 044 C1 | 5/1990 | Germany . |

*Primary Examiner*—Edgar S. Burr
*Assistant Examiner*—Amanda B. Sandusky
*Attorney, Agent, or Firm*—Leydig, Voit & Mayer, Ltd.

[57] ABSTRACT

A dampening unit for an offset printing machine having a plate cylinder which carries a printing form and which is operatively connected to applicator rollers of an inking unit and a dampening unit. The dampening applicator roller receives a dampening medium feed in front of the contact point with the plate cylinder and at least one roller for receiving dampening medium is in contact with the dampening medium applicator roller downstream of this contact point.

15 Claims, 2 Drawing Sheets

DAMPENING UNIT FOR AN OFFSET PRINTING MACHINE

FIELD OF THE INVENTION

The present invention relates generally to dampening units for offset printing machines, and more particularly, to dampening units that are operatively connected between an inking unit and a plate cylinder which carries a printing form.

BACKGROUND OF THE INVENTION

A dampening unit of the foregoing type is shown in German patent publication DE 3 416 485 A1. In this reference, the dampening unit includes a feed device for the dampening medium, a device for metering the dampening medium film, and an applicator roller which transfers the dampening medium film onto a plate cylinder and which can be coupled to an adjacent inking unit or operated separately. The dampening applicator roller in this case can be operated at a different circumferential speed than the plate cylinder so that a resulting wiping effect eliminates foreign particles.

German patent publication DE 3 432 807 A1, in conjunction with U.S. Pat. No. 4,724,764, discloses a more refined dampening unit. In addition to selectively operating the plate cylinder and dampening applicator roller at different circumferential speeds, an ink receiving roller, called a rider roller, is provided for the damping applicator roller. In this case, the ink-receiving roller rotates at a circumferential speed different from the plate cylinder and can be coupled to an adjacent inking unit or be operated separately.

A disadvantage of the foregoing prior art dampening units is that ink accumulating on the dampening applicator roller is carried into the dampening unit and consequently the ink/dampening medium equilibrium can become impaired. These impairments can take the form of stencilling (shadow-like markings) or cord streaks or striations which cause uneven printing.

OBJECTS AND SUMMARY OF THE INVENTION

It is an object of the present invention to provide an improved dampening unit for offset printing presses which is adapted for effecting uniform, fault-free feed of a dampening medium to the plate cylinder.

These objects are carried out in a dampening unit having at least one dampening applicator roller and at least one auxiliary or rider roller for receiving dampening medium from the dampening applicator roller downstream of the contact point of the dampening applicator roller and plate cylinder. In a preferred embodiment, a second or tandem auxiliary roller may be provided adjacent the rider roller in contact with the applicator roller for also receiving dampening medium. A desired water and ink structure can be formed on the dampening applicator roller downstream of the contact point of the dampening roller and plate cylinder. The first and second (rider and tandem) auxiliary rollers receiving dampening medium predominantly separate the dampening medium from the printing ink and preferably feed the dampening medium to the dampening applicator roller in reduced quantity at a different point. The ink/dampening medium mixture is leveled to a desired structure on the dampening applicator roller in such a way that the dampening applicator roller once again receives dampening medium fed by the dampening-medium feed device and transports it onto the print cylinder. If the ink/dampening medium mixture structure is not altered unstable dampening can result. Due to a dampening medium friendly surface of the rider roller or the combination rider roller and tandem roller, a better exchange of residual water therefore takes place between the dampening applicator roller, the rider roller, and if the appropriate, the tandem roller and, in turn, the dampening applicator roller. This results in a uniform surface structure of ink and dampening medium on the dampening applicator roller after contact with the rider roller or the combination of the rider and tandem rollers. These dampening medium-receiving rollers reduce the tendency of shadow-like marking, (stencilling) in surface printing and the cord-like streaks which cause uneven printing. It has been found that in a dampening unit according to the present invention, the feed of dampening medium from the dampening duct roller can be reduced and the use of alcohol also can be reduced. At the same time, in the printing process, the dampening unit can be coupled to the inking unit or can be operated separately.

Other objects and advantages of the invention will become apparent upon reading the following detailed description and upon reference to the drawings, in which:

Figure 1:
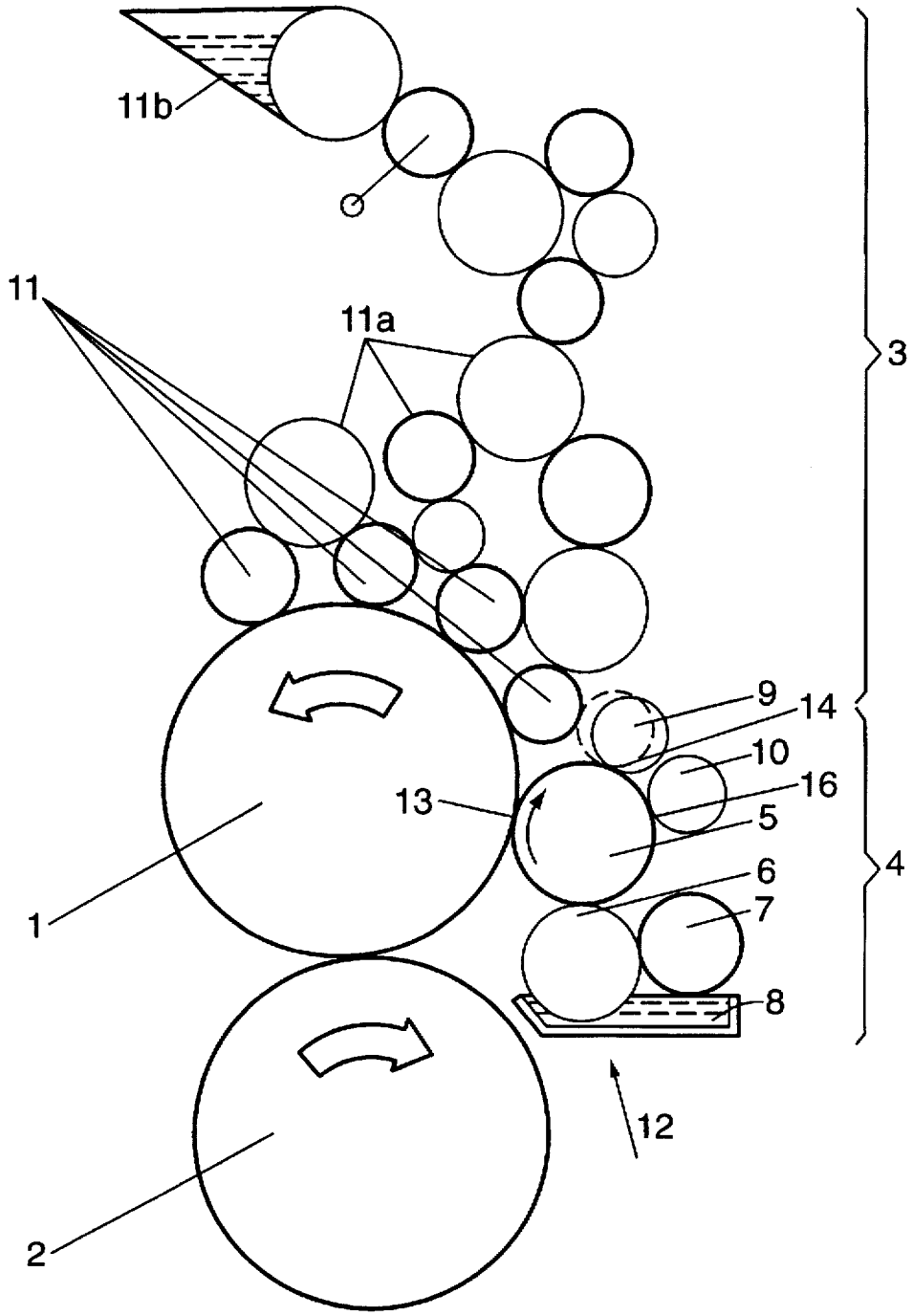
FIG. 1 is a diagrammatic depiction of a printing unit having a dampening unit according to the invention shown in uncoupled relation to the inking unit and having two auxiliary rollers for guiding dampening medium onto a dampening applicator roller.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE DRAWINGS

Referring now more particularly to the FIG. 1 of the drawings, there is shown a rotatable plate cylinder 1 of an offset printing machine having a dampening unit 4 in accordance with the present invention. For supplying ink to the plate cylinder, an inking unit 3 is provided, which comprises a plurality of ink applicator rollers 11 connected to ink feeding rollers **11*a* and ink supply 11*b* in a conventional way. The ink applicator rollers 11 are disposed in contacting relation with the plate cylinder 1 at circumferentially spaced intervals about the perimeter of the plate cylinder, and preferably, may be adapted for throw-on and throw-off movement. Rotational movement of the applicator roller may be transmitted from the plate cylinder 1 to the ink applicator rollers 11 non-positively through their friction contact. A second cylinder 2 may be also be positioned to roll against cylinder 1** in the manner illustrated.

For supplying a dampening medium to the plate cylinder 1, the dampening unit 4 includes a dampening applicator roller 5 disposed in contacting relation to the plate cylinder 1 at a point 13 which precedes the inking unit 3, as seen in the direction of rotation of the plate cylinder 1. For supplying dampening medium to the dampening applicator roller 5, the dampening unit includes a dampening feed device 12 which includes a dampening medium container 8, a dampening duct roller 6 in contacting relation with the dampening applicator roller 5 and disposed within the dampening medium container 8, and a dampening metering roller 7 in contacting relation to the duct roller 6 for creating a thin dampening medium film on the duct roller 6 for transfer to the dampening applicator roller 5. As illustrated in the FIGS., the duct roller 6 is rotatably positioned so that it is partially immersed in the dampening medium container 8.

In accordance with the invention, at least one auxiliary roller is mounted in contacting relation to the dampening applicator roller at a point in contact downstream of the contact point between the dampening applicator roller and the plate cylinder for receiving excess dampening medium. To this end, in the illustrated embodiment, a first auxiliary roller in the form of a rider roller 9 having a surface adapted for receiving the dampening medium is mounted in contacting relation with the dampening applicator roller at a contact point 14 at a point downstream of the contact point 13 between the dampening applicator roller 5 and the plate cylinder 1, as seen in the direction of travel of the dampening applicator roller. The auxiliary roller 9 preferably has a surface coating composed of a matt chromium. Alternatively, the auxiliary roller 9 may have a surface consisting of high grade steel or ceramic material capable of receiving dampening medium. The roller surface also be made of silicon metal or a silicon containing coating.

The dampening applicator roller 5 may be operated by a conventional reversible positive drive at a circumferential speed which is equal to or different from the circumferential speed of the plate cylinder 1. The rider roller 9 similarly has a drive which can rotate the rider roller with a circumferential speed equal to or different from the circumferential speed of the dampening applicator roller. The roller 9 also preferably has a transverse drive of a known type for moving the rider roller axially relative to the dampening applicator roller.

In keeping with the invention, the auxiliary roller 9 is operable as a bridge roller, being selectively movable from the solid line position shown in FIG. 1, into contacting relation with the inking unit. In the illustrated embodiment, the auxiliary roller 9 is movable into contacting relation with an ink applicator roller 11 of the inking unit 3 which is the first of the ink applicator rollers, as seen in the direction of rotation of the plate cylinder. Such movement may be effected by an appropriate reciprocating mechanism. The switched position of the ink auxiliary roller 9, as seen in broken lines in FIG. 1, is used for coupling the dampening unit 4 to the inking unit 3 for the purpose of washing the ink applicator rollers 11.

In carrying out a further aspect of the invention, a second or tandem auxiliary roller 10 for receiving dampening medium may be provided in contacting relation to the dampening applicator roller 5 at a contact point 16 downstream of the first auxiliary roller 9, as seen in the direction of rotation of the dampening roller 5. The second or tandem or auxiliary roller 10 may have a similar surface composition and traversing drive as the first auxiliary roller 9.

In the printing mode of operation of the printing machine, the dampening unit 4 is uncoupled from the inking unit 3 at a separating point 15 (shown in FIG. 2), such that the auxiliary roller 9 guiding dampening medium is separated from the first ink applicator roller 11. The dampening applicator roller 5 is operated via its reversible positive drive at a circumferential speed equal to or differing from the circumferential speed of the plate cylinder 1, and rotational movement is transmitted from the plate cylinder 1 to the ink applicator rollers 11.

Figure 2:
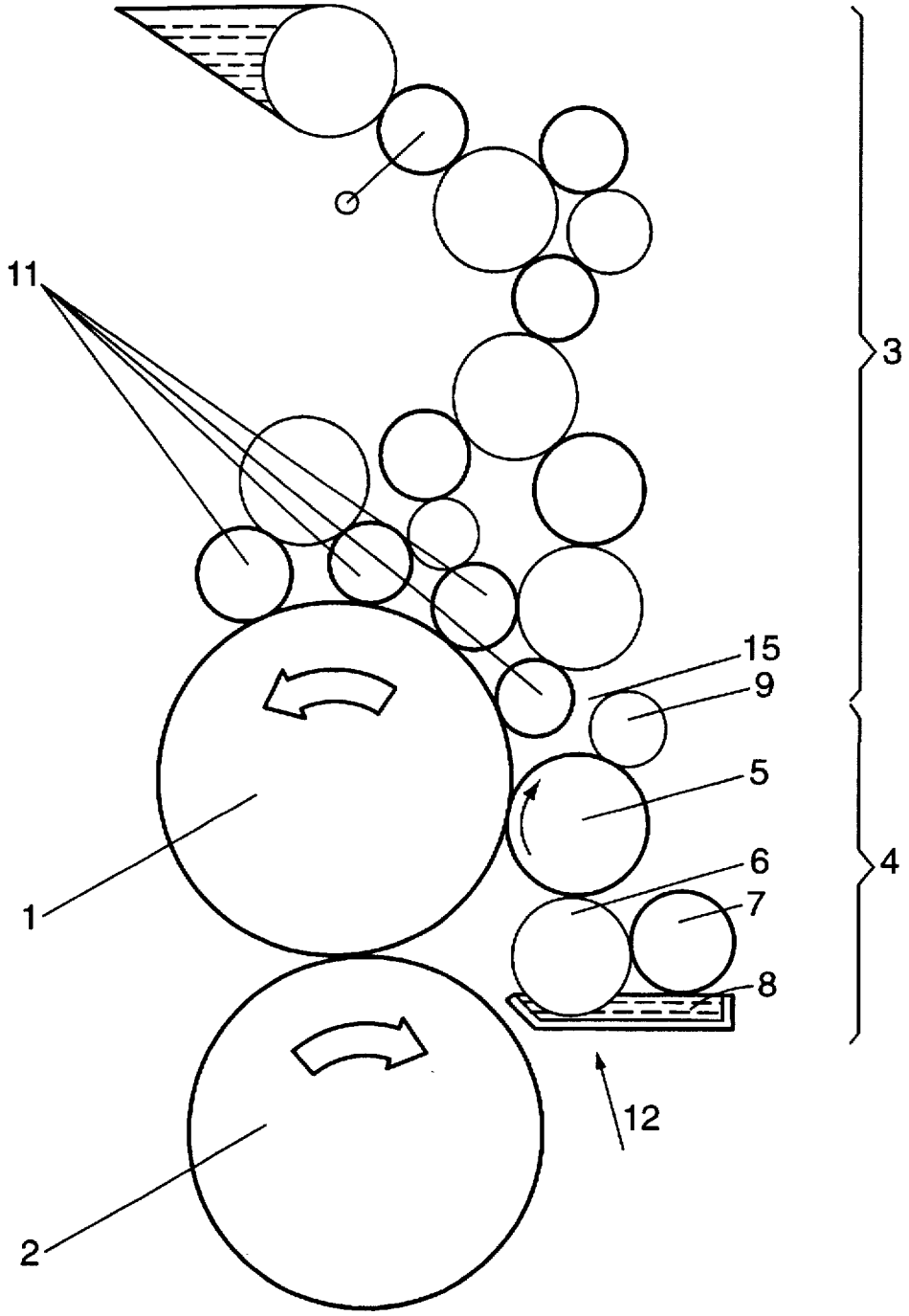
FIG. 2 is a printing unit having a dampening unit similar to that shown in FIG. 1, but having a single rider or auxiliary roller for guiding dampening medium onto the dampening applicator roller.

It will be understood that the second or tandem auxiliary roller 10 may not always be necessary to effect desired levelling and transfer of the dampening medium. In some cases, as shown in FIG. 2, only one auxiliary roller 9 for receiving dampening medium need be provided. This embodiment preferably is used when the dampening applicator roller 5 carries and transfers relatively small amounts of dampening medium. The auxiliary roller 9 then operates satisfactorily in working the dampening medium film adequately into the printing ink present on the dampening applicator roller for flaw proof printing.

In addition to the dampening applicator roller 5, the auxiliary roller 9 carrying dampening medium can also be operated at a circumferential speed different from or equal to that of the dampening applicator roller 5. In this case, the roller 10 located downstream of the roller 9 can likewise be operated at a circumferential speed different from or equal to that of the dampening applicator roller 5. The cylinder generatrix of the rollers 9 and 10 is preferably identical to the length of the arc of the circle of the channel of the plate cylinder 1.

Depending on the printing requirements, a desired structure of dampening medium and ink is formed on the dampening applicator roller 5 downstream of the contact point 13 of the dampening applicator roller 5/plate cylinder 1. This structure is levelled by the dampening medium receiving roller 9, as well as the further dampening medium receiving roller 10 when used. The surface structure of the ink/dampening medium mixture is distributed uniformly on the dampening applicator roller 5. In addition to the dampening medium feed device 12, the auxiliary rollers 9 and 10 have a blocking function relative to the ink on the ink applicator roller 5, the blocking function appreciably preventing the return transport of printing ink into the dampening unit 4 and at the same time guaranteeing stable metering of the dampening medium in the form of a very thin dampening film.

What is claimed is:

1. An offset printing machine comprising a rotatable plate cylinder having a printing form, an inking unit having at least one rotatable ink applicator roller for transferring ink to the plate cylinder, a dampening unit having at least one rotatable dampening applicator roller in contacting relation to said plate cylinder for transferring a dampening medium to said plate cylinder at a determined contact point, a first auxiliary roller in contact with said dampening applicator roller at a contact point downstream of the contact point of the dampening applicator roller with said plate cylinder and having a surface made of a material for receiving dampening medium from the dampening applicator roller, a second auxiliary roller in contact with said dampening applicator roller downstream of the contact point of said first auxiliary roller with said dampening applicator roller for also receiving dampening medium from said dampening applicator roller, and a drive for rotating at least one of said auxiliary rollers at a circumferential speed different from the circumferential speed of the dampening applicator roller.

2. The offset printing machine of claim 1 including a dampening duct roller rollably contacting said dampening applicator roller for supplying dampening medium to said dampening applicator roller at a contact point in front of the contact point of said dampening applicator roller with said plate cylinder in the direction of rotation of said dampening applicator roller, said dampening duct roller being partially immersed in a container of dampening medium.

3. The offset printing machine of claim 1 further comprising means for axially moving at least one of said auxiliary rollers relative to said dampening applicator roller.

4. The offset printing machine of claim 1 in which said first auxiliary roller is a bridge roller, said offset printing machine further comprising means for selectively moving said first auxiliary roller into contacting engagement with said inking unit.

5. The offset printing machine of claim 1 further comprising means for moving said first auxiliary roller between an uncoupled position and a position of contacting engagement relative to said printing unit such that during a printing mode of operation of the machine the first auxiliary roller is in said uncoupled position relative to the inking unit, and in which following a printing mode of operation, the first auxiliary roller is moveable by said means into said position of contacting engagement with said inking unit.

6. The offset printing machine of claim 1 in which at least one of said auxiliary rollers has a surface composed of chromium.

7. The offset printing machine of claim 1 in which at least one of said auxiliary rollers has a surface composed of a ceramic.

8. The offset printing machine of claim 1 in which at least one of said auxiliary rollers has a surface composed of steel.

9. The offset printing machine of claim 1 in which at least one of said auxiliary rollers has a surface which contains silicon.

10. An offset printing machine comprising a rotatable plate cylinder having a printing form, an inking unit having at least one rotatable ink applicator roller for transferring ink to the plate cylinder, a dampening unit having at least one rotatable dampening applicator roller in contacting relation to said plate cylinder for transferring a dampening medium to said plate cylinder at a determined contact point, a first auxiliary roller in contact with said dampening applicator roller at a contact point downstream of the contact point of the dampening applicator roller with said plate cylinder and having a surface made of a material for receiving dampening medium from the dampening applicator roller, a second auxiliary roller in contact with said dampening applicator roller downstream of the contact point of said first auxiliary roller with said dampening applicator roller and having a surface made of a material for receiving dampening medium from said dampening applicator roller, and a drive for rotating said first and second auxiliary rollers at circumferential speeds different from a circumferential speed of the rotatable dampening roller.

11. The offset printing machine of claim 10 including a dampening duct roller rollably contacting said dampening applicator roller for supplying dampening medium to said dampening applicator roller at a contact point in front of the contact point of said dampening applicator roller with said plate cylinder in the direction of rotation of said dampening applicator roller, said dampening duct roller being partially immersed in a container of dampening medium.

12. An offset printing machine comprising a rotatable plate cylinder having a printing form, an inking unit having at least one rotatable ink applicator roller for transferring ink to the plate cylinder, a dampening unit having at least one rotatable dampening applicator roller in contacting relation to said plate cylinder for transferring a dampening medium to said plate cylinder at a determined contact point, a first auxiliary roller in contact with said dampening applicator roller at a contact point downstream of the contact point of the dampening applicator roller with said plate cylinder, a second auxiliary roller in contact with said dampening applicator roller downstream of the contact point of said first auxiliary roller with said dampening applicator roller, and at least one of said auxiliary rollers has a surface made of a material for receiving dampening medium from the dampening applicator roller and for blocking the transfer of ink.

13. The offset printing machine of claim 12 in which said first auxiliary roller has a surface made of a material for receiving dampening medium from the applicator roller and for blocking the transfer of ink.

14. The offset printing machine of claim 12 in which said auxiliary rollers each have a surface made of a material for receiving dampening medium from the dampening applicator roller and for blocking the transfer of ink.

15. The offset printing machine of claim 12 further comprising means for axially moving said first and second auxiliary rollers relative to the dampening applicator roller.

* * * * *